US006182377B1

(12) United States Patent
Toensing

(10) Patent No.: US 6,182,377 B1
(45) Date of Patent: Feb. 6, 2001

(54) DIVE BOOT

(76) Inventor: Mark Toensing, 14 Highland Rd., Sharon, CT (US) 06069

( * ) Notice: Under 35 U.S.C. 154(b), the term of this patent shall be extended for 0 days.

(21) Appl. No.: 09/417,720

(22) Filed: Oct. 13, 1999

(51) Int. Cl.[7] ..... A43B 5/08
(52) U.S. Cl. ..... 36/8.1; 441/64
(58) Field of Search ..... 36/8.1, 4; 441/61, 441/64

(56) References Cited

U.S. PATENT DOCUMENTS

| | | | |
|---|---|---|---|
| 193,077 | | 7/1877 | Clayton . |
| 1,051,615 | | 1/1913 | Montllor . |
| 1,303,565 | | 5/1919 | Lambert . |
| 1,742,176 | | 12/1929 | Hebig . |
| 1,877,080 | | 9/1932 | Teshima . |
| 3,574,958 | | 4/1971 | Martuch ..... 36/2.5 |
| 3,629,051 | * | 12/1971 | Mitchell . |
| 3,863,272 | * | 2/1975 | Guille . |
| 4,317,292 | * | 3/1982 | Melton . |
| 4,984,377 | * | 1/1991 | Schneider . |
| 5,324,219 | * | 6/1994 | Beltrani et al. . |
| 5,553,399 | * | 9/1996 | Strong . |
| 5,766,050 | * | 6/1998 | Maggi . |
| 5,913,592 | | 6/1999 | Moore ..... 36/8.1 |
| 6,035,554 | * | 3/2000 | Duncan . |

FOREIGN PATENT DOCUMENTS

| | | | |
|---|---|---|---|
| 4253801 | * | 4/1992 | (JP) . |

* cited by examiner

*Primary Examiner*—Ted Kavanaugh
(74) *Attorney, Agent, or Firm*—William C. Crutcher

(57) ABSTRACT

A dive boot for wearing with swim fins and having a felt sole to prevent slipping on underwater objects when entering the water without the fin.

6 Claims, 2 Drawing Sheets

DIVE BOOT

Figure 3:
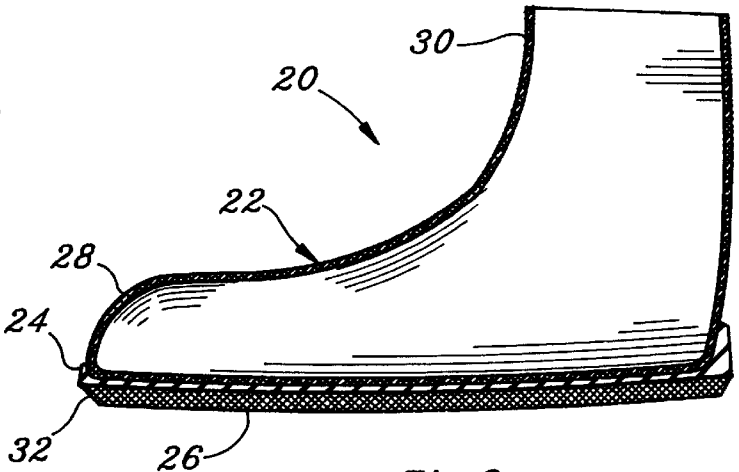

This invention relates to a boot for swimming, snorkeling or scuba diving, and more particularly to an improved dive boot to be used both for entering the water from the shore on foot and to be used together with swim fins or flippers.

BACKGROUND OF THE INVENTION

When swimming, snorkeling or scuba diving, dive boots are often worn to protect the feet from injury on foreign objects, as well as for warmth in colder waters. Dive boots are shaped to be worn together with swim fins or flippers of the type having a toe entry pocket and means for heel attachment, such as a strap or heel cup.

Entry into the water from the shore is difficult while wearing swim fins, particularly in a heavy surf. The diver usually enters the water on foot, carrying the swim fins and then puts them on after negotiating the shallow water. Entry on foot is difficult, and sometimes dangerous, due to foreign objects in the water, which are often slippery. The diver may encounter rocks covered with barnacles and algae, seaweed, shells, and other dangerous debris such as broken glass. Prior art dive boots normally are made with synthetic rubber soles having corrugated bottoms or treads. While these offer protection to the feet and are puncture resistant, the soles of prior art dive boots are notably slippery in spite of the corrugated treads. Also the rubber soles are flexible and produce fatigue when used with fins for a long time.

Wading shoes or wading boots are also known, which offer improved traction on slippery surfaces. Wading shoes or boots are available with felt soles having an instep and heel configured in the manner of an ordinary walking shoe. The soles of prior art wading shoes have a peripheral rim extending beyond the toe piece of the upper boot member and are not suitable for use as diving boots.

A prior art dive boot is disclosed in detail in U.S. Pat. No. 5,913,592 to Moore. This boot uses a sole pad of flexible and compressible material, such as natural rubber. Other patents have disclosed wading shoes or boots with various types of soles, including U.S. Pat. No. 3,574,958 to Martuch describing a boot with a sole of inner-woven matted polymeric material; U.S. Pat. No. 1,877,080 to Teshima with a woven sole of Japanese hemp palm fiber or manila fiber, U.S. Pat. No. 1,742,176 with a rubber sponge sole and 1877 patent to Clayton describing a canvas shoe with cork sole.

It would be desirable to have a dive boot which especially useful both for walking on slippery surfaces when entering the water, as well as to be used with a swim fin for a dive boot. It would also be desirable to have a dive boot which reduces fatigue when swimming with fins over the boot.

Accordingly, one object of the invention is to provide an improved dive boot both for walking on slippery surfaces and for wearing with a swim fin.

Another object of the invention is to provide an improved dive boot which reduces fatigue when worn with swim fins.

SUMMARY OF THE INVENTION

Briefly stated, the invention comprises an improved dive boot to be used both for shore entry and with a swim fin of the type having a toe entry pocket and heel attachment means, the dive boot comprising an upper boot member of water resistant fabric having a substantially smooth toe piece adapted to enter the swim fin toe entry pocket, an intermediate sole member attached to the bottom of the upper boot member, and a bottom sole member comprising felt attached to the intermediate sole member, the bottom sole member having a substantially flat lower surface. Preferably the felt is a synthetic felt of uniform thickness woven of polyester and nylon and beveled along its periphery to facilitate entry of the boot toe piece into a swim flipper toe entry pocket.

DRAWINGS

Figure 4:
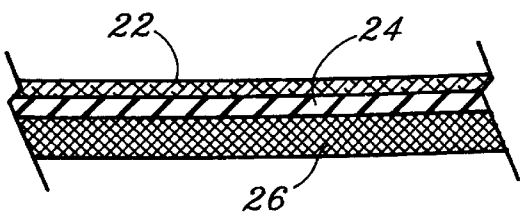
Figure 1:
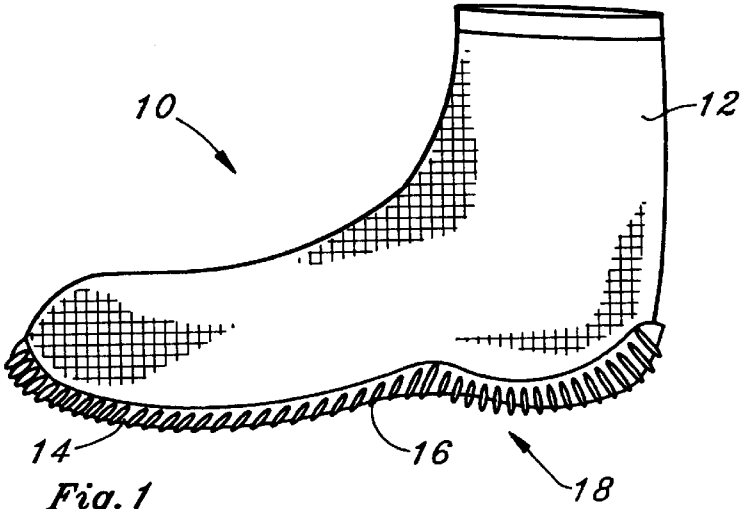
Fig. 1 (Prior Art)
Figure 2:
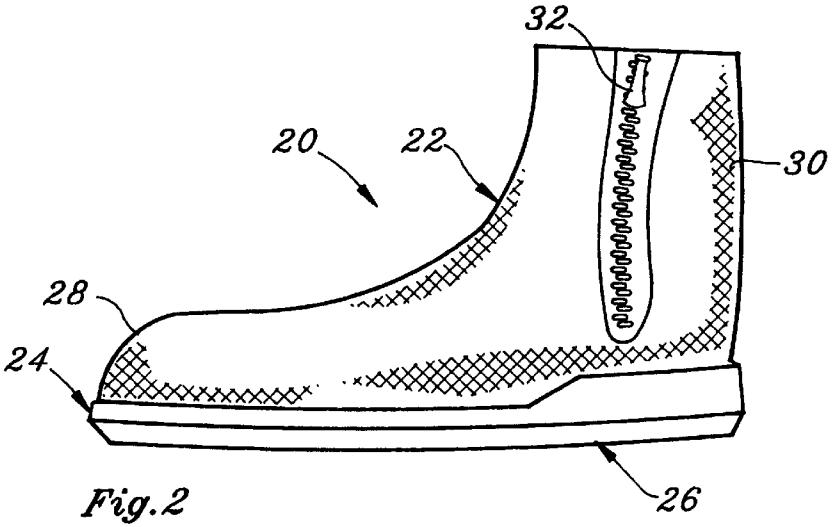
Figure 5:
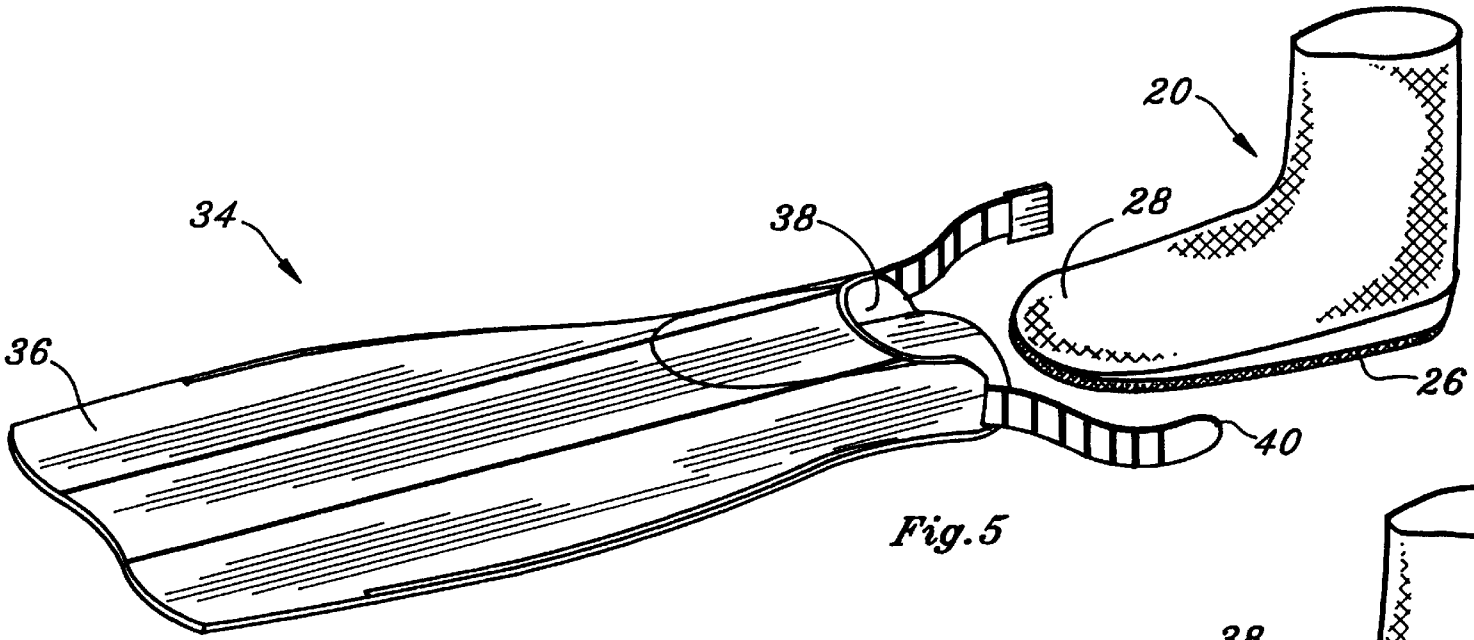
Figure 6:
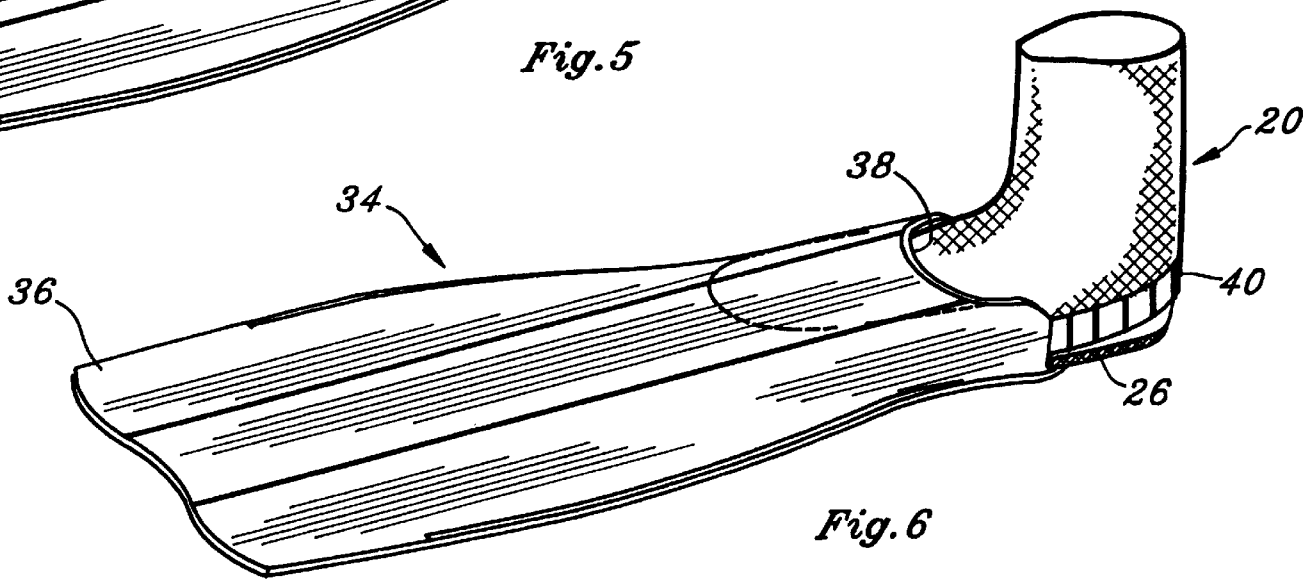

The invention, both as to organization and method of practice, together with further objects and advantages thereof, will best be understood by reference to the following description, taken in connection with the accompanying drawings, in which:

FIG. 1 is a side elevation view of a prior art dive boot,

FIG. 2 is a side elevation view of the dive boot according to the present invention, FIG. 3 is a side elevation view, in cross section, taken through the center line of the boot of FIG. 2, FIG. 4 is an enlarged side elevational view and cross section of a portion of the sole of the improved dive boot, FIG. 5 is a perspective view of the dive boot according to present invention together with a swim fin, and FIG. 6 is a similar perspective view of the dive boot inserted into the toe entry pocket of the swim fin and attached with a heel strap.

DESCRIPTION OF THE PREFERRED EMBODIMENT

Referring now to FIG. 1 of the drawing, a prior art dive boot 10 comprises an upper boot member 12, which is manufactured of water resistant fabric, which may be stretchable fabric and provided with a side closure member such as a zipper (not shown). Dive boot 10 has a heavy sole 14 of natural or synthetic rubber, molded to include corrugations or ridges 16 to prevent slipping and add traction. The corrugations 16 run laterally across the boot and provide flexibility at the arch 18. When used with a swim fin, the flexible arch 18 sometimes increases fatigue because of the effort required to move the foot against the resistance of the water to the swim fin.

FIG. 2 illustrates the dive boot of the present invention, which is shown generally at 20, to comprise an upper boot member 22, an intermediate sole member 24 and a bottom sole member 26. Upper boot member 22 comprises a toe piece 28 and an ankle sheath 30, the latter being supplied with a closure device such as a zipper 32. The upper boot member is made of water resistant, flexible fabric, such as woven Neoprene material, which may also be stretchable.

Intermediate sole member 24 is preferably made of synthetic rubber and is attached to the bottom of the upper boot member by adhesive in a manner well known in the art.

In accordance with the present invention, a bottom sole member 26 of felt is attached to the intermediate sole member 24, preferably with an adhesive.

Reference to the cross sectional drawing of FIG. 3 illustrates that the intermediate sole member 24 is substantially flat on its bottom surface, and that the felt bottom sole member is of substantially uniform Ahickness. The periphery of the felt bottom sole member is beveled inwardly toward the bottom surface away from the boot, as indicated at 32 to facilitate entry of the boot into a swim fin toe entry pocket.

The preferable material for the bottom sole member 32 comprises a felt member approximately ⅜" uniform thickness made from a needled blend of 60% polyester and 40% nylon. Preferably, the bottom sole member is attached to the intermediate sole member with a rubber adhesive, or a two part adhesive consisting of polyester and polyether.

FIG. 4 is an enlarged cross section view showing the details of the upper boot member 22, the intermediate sole member 24 and the bottom sole member 26.

OPERATION

Referring now to the perspective drawings of FIGS. 5 and 6, the improved dive boot 20 with felt bottom sole 26 is worn without fins while entering the water. Felt sole 26 prevents, or substantially reduces, slipping on underwater objects. The boot is constructed to be worn with a swim fin shown generally at 34 comprised of synthetic rubber or plastic, and of a type well known in the art. Fin 34 comprises a flipper portion 36, a toe entry pocket 38, and heel attachment means such as strap 40. Swim fin 34 is carried while entering the water.

FIG. 6 shows the dive boot 20 with toe piece 28 inserted into the toe entry pocket 38 and strap 40 secured in place around the heel of dive boot 20 to hold it securely in the toe pocket. The toe piece and beveled felt sole 26 are shaped and contoured to facilitate entry of the dive boot into the toe pocket. During diving and swimming, the flat felt sole 26 provides rigidity and reduces fatigue while manipulating the fins. The felt sole is also useful for avoiding slipping while wearing the swim fins, because the back part of the bottom sole remains exposed.

While there has been described what is considered to be the preferred embodiment of the invention, other modifications will occur to those skilled in the art, and it is desired to secure in the appended claims all such modifications as fall within the true spirit and scope of the invention.

What is claimed is:

1. A dive boot to be used both for shore entry and with a swim fin of the type having a toe entry pocket and heel strap attachment means, said dive boot comprising:

an upper boot member of water resistant fabric having a bottom and a substantially smooth toe piece adapted to enter said swim fin toe entry pocket, an intermediate sole member attached to the bottom of said upper boot member and having a substantially flat lower surface, and a bottom sole member comprising synthetic felt of substantially uniform thickness attached to said intermediate sole member, said bottom sole member having a substantially flat lower surface and having a periphery which is beveled along portions thereof to facilitate entry of said toe piece into said swim fin toe entry pocket.

2. The combination according to claim 1, wherein the synthetic felt comprises a felt woven of polyester and nylon.

3. The combination according to claim 1, wherein the intermediate sole member is made of synthetic rubber and wherein the bottom sole member is attached thereto by a rubber adhesive.

4. The combination according to claim 1, wherein the upper boot member is made of a stretchable water resistant fabric.

5. The combination according to claim 1, wherein the upper boot member includes a zipper closure disposed on one side thereof.

6. A dive boot to be used both for shore entry and with a swim fin of the type having a toe entry pocket and heel strap attachment means, said dive boot comprising:

an upper boot member of water resistant fabric having a substantially smooth toe piece adapted to enter said swim fin toe entry pocket, an intermediate sole member attached to the bottom of said upper boot member, said intermediate sole member of synthetic rubber having a substantially flat lower surface, and a bottom sole member comprising synthetic felt of substantially uniform thickness and woven of polyester and nylon, said bottom sole member being attached to said intermediate sole member by a rubber adhesive, said bottom sole member having a substantially flat lower surface and having a periphery beveled along portions thereof to facilitate entry into said swim fin toe entry pocket.

* * * * *